US005411307A

United States Patent [19]

Roberts

[11] Patent Number: 5,411,307

[45] Date of Patent: May 2, 1995

[54] GRIP FOR USE ON BAGS HAVING HANDHOLDS

[76] Inventor: Mark J. Roberts, 409 W. Mercer Way #404, Seattle, Wash. 98119

[21] Appl. No.: 239,917

[22] Filed: May 9, 1994

[51] Int. Cl.[6] ..... A45C 13/22; B65D 33/06

[52] U.S. Cl. ..... 294/171

[58] Field of Search ..... 294/137, 153, 154, 166, 294/170, 171; 16/114 R, 114 B; 383/6, 13, 25, 29

[56] References Cited

U.S. PATENT DOCUMENTS

| | | | |
|---|---|---|---|
| 967,531 | 8/1910 | Leuschner | 294/171 |
| 2,519,186 | 8/1950 | Herbert et al. | 294/171 X |
| 4,846,519 | 7/1989 | Leonard | 294/171 |
| 4,936,619 | 6/1990 | Salazar | 294/171 |
| 4,946,065 | 8/1990 | Goulter et al. | 294/171 X |
| 4,982,989 | 1/1991 | Sweeny | 294/171 |

FOREIGN PATENT DOCUMENTS

| | | | |
|---|---|---|---|
| 3509679 | 9/1986 | Germany | 294/171 |
| 3918355 | 12/1990 | Germany | 294/171 |
| 2078497 | 1/1982 | United Kingdom | 294/171 |
| 2135179 | 8/1984 | United Kingdom | 294/171 |
| 2147200 | 5/1985 | United Kingdom | 294/171 |

*Primary Examiner*—Johnny D. Cherry
*Attorney, Agent, or Firm*—Robert W. Jenny

[57] ABSTRACT

The grip is approximately 3½ inches long and has a generally U-shaped cross section shape with the sides touching at their edges at the mid length point of the grip and at increasing distances from each other toward the ends of the grip. A flange on the edge of one side extends at 90° to the side toward the other side. The edge of the other side extends beyond the flange and curves away from the flange to form a ledge. The bottom of the U-shape is the bottom of the grip and it is arched upward lengthwise at a radius about 4 times the length of the grip. The flange may extend the full length of the grip or extend only over a central portion of the length. The ledge facilitates engaging the grip on the bail or bails of a bag. The flange inhibits inadvertent disengagement of the grip from the bail(s).

1 Claim, 1 Drawing Sheet

GRIP FOR USE ON BAGS HAVING HANDHOLDS

BACKGROUND OF THE INVENTION

1. Field

The subject invention is in the field of devices used to alleviate discomfort of a hand applying force to an object, devices such as the grips on hand operated levers, tools and the like. More specifically, it is in the field of devices which distribute forces involved in holding a handhold over the involved surfaces of the hand. Still more specifically, it is in the field of such devices designed for use with the handles of buckets and the like and the handholds on shopping bags, plastic grocery bags and the like.

2. Prior Art

There is much prior art in this specific field and the patents listed below are a sample of the prior art known to the inventor of the subject invention.

| | | |
|---|---|---|
| U.S. Pat. Nos.: | 391,896 | 2,519,186 |
| | 1,008,604 | 2,827,329 |
| | 1,468,848 | 3,083,366 |
| | 2,274,605 | 4,590,640 |
| | | 4,846,519 |
| British: | 2,147,200A | |

Of particular interest are the British patent to Simon et al and U.S. Pat. Nos. 3,083,366 to Franges and 4,846,579 to Leonard.

Leonard discloses a grip which is essentially straight, circular in cross sectional shape, slotted lengthwise to receive the bails of the container to be gripped and having spout-like shapes at the ends of the bail supporting interior surface. The lengthwise slot is narrowed near the lengthwise center of the grip to limit the possibility of the bail(s) inadvertently slipping out of the grip. However, it is considered that the straightness of the load bearing surface detracts from the comfort of using the grip and that the narrowing of the slot does not adequately limit disengagement of the grip from the bails if, for example, the bag is set down temporarily and the grip is released. Also, the conformation of the slot does not facilitate installation of the grip on the bails.

The Franges handle has a comfortable curved lengthwise load bearing surface but offers very little restraint to prevent inadvertent disengagement of the bails from the grip. Also, the configuration of the lengthwise opening in the handles does not facilitate installation of the handle on the bails.

The handle of Simon et al has specific indentations provided for making the engagement of the handle on the bails more secure. However, the load bearing surface contacting the fingers of the hand holding the handle is curved to generally conform to finger shapes but has a generally straight conformation lengthwise rather than the preferred curved conformation. Also, while the lengthwise opening which accepts the bails is wider than the equivalent openings of Franges and Leonard, the handle is not specifically contoured to facilitate engaging the handle on the bail(s). Also, the handle of Simon et al is considered to require more material to manufacture than is economically acceptable, based on the fact that once the costs of the molds are paid, the cost of the molded part is largely based on the amount of material required per part.

In view of the above observations, the primary objective of the subject invention is to provide a grip for bags having handholds, which grip embodies the following four features: The load bearing surface contacted by a user's fingers is gently curved lengthwise. The grip is conformed to facilitate its engagement on the bail(s) or the like. The grip embodies features which distinctly inhibit inadvertent disengagement of the grip from the bail(s) without increasing the difficulty of purposeful disengagement of the grip from the bail(s). The grip is compact for its intended purpose and therefore can be manufactured with a minimum of material per part.

SUMMARY OF THE INVENTION

The subject invention is a grip for use on bags having handholds. The two most common forms of such handholds are lengths of cords with their ends attached to the edges of the open ends of the bags and bags having holes in the sides of the bags near the open ends of the bags. For purposes of this disclosure the material grasped to hold the bag is termed the bail or bails. In a preferred embodiment the grip is made of one piece of generally uniform thickness and is generally U-shaped in cross section. The length of the channel is approximately three times the maximum dimension across the cross section. The invention is characterized primarily by the details of its cross sectional shape. The sides of the U-shape touch each other at the nominally open end of the U-shape at an intermediate point of the length of the grip. The distance between the edges increases toward each end of the grip from the intermediate point with the distances at the ends being in a range of $\frac{1}{8}$ to $\frac{1}{2}$ inch with $\frac{1}{4}$ inch preferred. One of the edges is flanged with the flange at about 90° to the side of the grip and extending toward and contacting the other, non-flanged, side near an intermediate point of the grip. The other edge, on the non-flanged side, curls away from the contact and space between the edges and extends beyond the upper surface of the flange on the flanged edge, curving away at an angle in a range of 10° to 50°, with 40° preferred, to form a ledge. To install the grip on the bail(s), the bail(s) are placed on the ledge. Then, when the grip is moved or pressed against the bail(s), the bail(s) enter(s) the gaps between the flanged and curled edges at the ends of the grip and easily move between the edges to the bottom of the grip. The contact between the edges at the intermediate point of the grip prevents inadvertent disengagement of the grip from the bail(s). Disengagement is facilitated by slopes at the ends of the flange which spread the edges apart by camming action as the bails are pulled against the slopes to effect disengagement of the grips from the bail(s).

The invention is described in more detail below with reference to the attached drawings.

BRIEF DESCRIPTIONS OF THE DRAWINGS

DETAILED DESCRIPTION OF THE INVENTION

Figure 1:
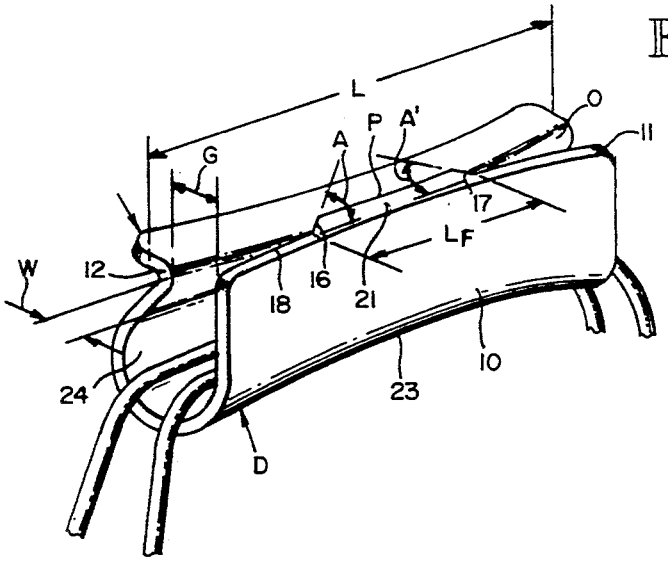
FIG. 1 illustrates the subject grip engaged on the bails of a bag.

The subject invention is a grip for use on bags having handholds comprising bails as defined above for purposes of this disclosure. FIG. 1 illustrates a preferred embodiment of the grip 10 being a channel having a generally U-shaped cross sectional shape, a length L and a major cross sectional dimension D. The ratio of L to D in a range of 2 to 5 with 3.5 preferred. Slot O extends lengthwise of the grip with the width W of gap G ranging along the length and being zero near the intermediate point P and in a range of $\frac{1}{8}$ to $\frac{1}{2}$ inch at the ends 11 and 12 with $\frac{1}{4}$ inch preferred.

Figure 2:
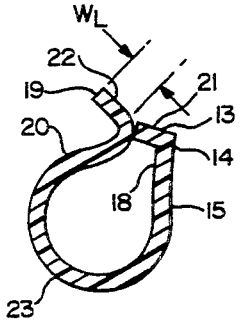
FIG. 2 is a section taken at 2—2 in FIG. 1.

FIG. 2 is a section taken at 2—2 in FIG. 1, illustrating in more detail the cross sectional shape of the grip. Flange 13 extends from edge 14 of side 15 essentially at 90° to side 15 and across gap G. The flange may extend the length of the grip or its length $L_F$ may be a fraction of the length, the fraction being in a range of 0.1 to 0.9 with 0.20 preferred, the flange being centered on the length of the grip. Angles A and A' between end surfaces 16 and 17 of the flange and surface 18 of side 15 are in a range of 45° to 90° with 45° preferred.

Edge 19 of side 20 extends beyond surface 21 of the flange and side 20 curves away from the flange to form ledge 22 which extends the full length of the grip in this embodiment with width $W_L$ being in a range of $\frac{1}{8}$ to $\frac{5}{8}$ of an inch with $\frac{3}{8}$ preferred. The ledge is at an angle to side 15 in a range of 10° to 50° with 40° preferred. In other embodiments width $W_L$ decreases toward each end of the grip from its full width in the mid length portion of the grip.

To provide the variation of width W of gap G described above one or both of edges 14 and 19 is/are curved away from each other such that width W is zero near the center portion lengthwise of the grip, with the flange and ledge contacting in the center portion.

Bottom portion 23 (FIG. 1) is arched upward into channel 24 of the grip. The radius of the arch is in a range of 3 to 6 times the length of the grip with 4 preferred.

Figure 3:
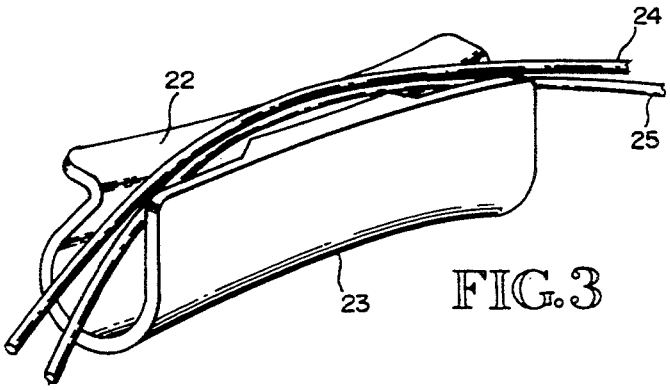
FIG. 3 illustrates the bails of a bag ready to be engaged by the grip.

In use, to engage the bails of a bag in the grip, bails 24 and 25 in FIG. 3 are laid on ledge 22 with the grip held so that the ledge slopes toward the flange. The bails tend to slip into slot O near the ends of the grip where the slot is wider. Pressure on the bottom of the grip in opposition to the tension in the bails caused by the weight of contents of the bag causes the bail to slide up an end surface of the flange to separate the sides and slip into the channel of the grip. The slopes of the ends of the flange facilitate this operation more when they are shallow. However, if they are too shallow, one or both bails can wedge the sides of the grip apart and allow inadvertent disengagement of the grip from the bails. On the other hand, if the angles A and A' are at the preferred 45°, such wedging is unlikely to occur and inadvertent disengagement of the grip from the bails is highly unlikely.

Figure 4:
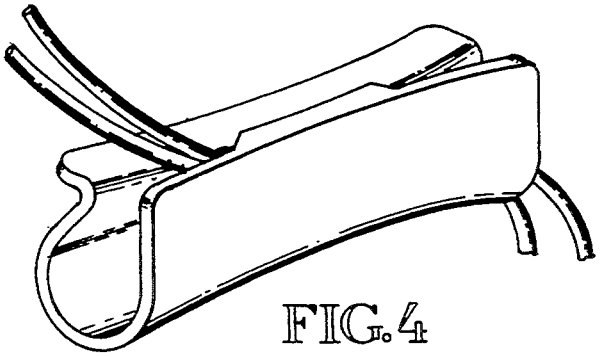
FIG. 4 illustrates the bails of a bag being disengaged from the grip.

FIG. 4 illustrates the technique for purposeful removal of the grip. The bails are forced against a sloped end of the flange, wedging the sides apart enough to allow easy removal of the grip.

Selection of an appropriate material from which to make the grip and selection of the proper thickness are considered to be well within the capabilities of persons of ordinary skill in the art. Injection molding of plastic is considered to be the most feasible method of manufacture. The relative flatness of side 15 enhances its use for placement of indicia on it.

It is considered to be understandable from this description that the subject invention meets its objectives. The bottom, load bearing surface is curved lengthwise. Engagement of bails or the like is facilitated by the ledge and variations of width of the slot. The flange clearly inhibits inadvertent disengagement of the grip from bails while purposeful disengagement is facilitated by the variations in width of the slot and the slopes at the ends of the flange. The grip is compact, requiring no more material than necessary to surround the bails and provide for the ledge.

It is also considered to be understood that while certain embodiments of the invention are described herein, other embodiments and modifications of those disclosed are possible within the scope of the invention which is limited only by the attached claims.

I claim:

1. A grip for use on bags having handholds, said handholds comprising bails, said grip being a channel having a U-shaped cross sectional shape and having first and second sides, a bottom, a length, first and second ends and an intermediate length point, said first and second sides having first and second edges respectively, said grip further comprising a flange extending from said first edge of said first side toward said second side and centered on said length and extending over a portion of said length, said portion being in a range of 0.1 to 0.9 of said grip length, said second side extending past said flange and curving away from said first side to form a ledge at an angle to said first second side, said angle being in a range of 10° to 50°, said ledge having a width in a range of $\frac{1}{8}$ to $\frac{5}{8}$ of an inch, at least one of said edges being curved such that said flange and said ledge are in contact at said intermediate length point and such that said flange and said ledge extend away from each other toward said first and second ends, said bottom being arched between said first and second ends at a radius in a range of 3 to 6 times said length.

* * * * *